US008177581B2

(12) United States Patent
Zeng

(10) Patent No.: US 8,177,581 B2
(45) Date of Patent: May 15, 2012

(54) ELECTRICAL CONNECTOR WITH BOARD LOCKS WITH RETAINING PORTIONS ABUTTING BLOCK PORTIONS OF THE CONNECTOR

(75) Inventor: Wei-Xiong Zeng, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/080,665

(22) Filed: Apr. 6, 2011

(65) Prior Publication Data

US 2012/0015564 A1 Jan. 19, 2012

(51) Int. Cl.
*H01R 13/66* (2006.01)

(52) U.S. Cl. ..... 439/567

(58) Field of Classification Search ..... 439/74, 439/79, 569–572, 362, 374
See application file for complete search history.

(56) References Cited

U.S. PATENT DOCUMENTS 6,648,682 B1 * 11/2003 Wu ..... 439/567
7,128,582 B2 * 10/2006 Fang et al. ..... 439/79
7,611,381 B2 * 11/2009 Lei ..... 439/567
7,892,006 B2 * 2/2011 Guan et al. ..... 439/328
2005/0272308 A1 * 12/2005 Pan et al. ..... 439/567
2009/0017677 A1 * 1/2009 Lei ..... 439/567

* cited by examiner

*Primary Examiner* — Chandrika Prasad
(74) *Attorney, Agent, or Firm* — Wei Te Chung; Andrew C. Cheng; Ming Chieh Chang

(57) ABSTRACT

An electrical connector includes an insulative housing, a plurality of terminals and a pair of board locks retained in the housing. The insulative housing defines a mating surface, a mounting surface opposite to the mating surface, a plurality of passageways penetrating through the mating surface and a pair of slots penetrating through the mounting face and a first side face of the insulative housing. The terminals are received in the passageways. The board locks are secured in the corresponding slots of the insulative housing. Each board lock includes a retention portion and a lock tail extending from the retention portion beyond the mounting face. The insulative housing further defines a pair of block portions unitarily protruding from the first side face adjacent to the corresponding slots, and each board lock includes a retaining portion abutting against the corresponding block portion on a face opposite to the mounting face.

11 Claims, 3 Drawing Sheets

ELECTRICAL CONNECTOR WITH BOARD LOCKS WITH RETAINING PORTIONS ABUTTING BLOCK PORTIONS OF THE CONNECTOR

FIELD OF THE INVENTION

The present invention generally relates to an electrical connector, and more particularly to an electrical connector with a pair of board locks and method of assembling the board locks thereof to the connector.

DESCRIPTION OF PRIOR ART

Conventionally, an electrical connector comprises an insulative housing and a number of terminals received in the insulative housing and a pair of board locks secured at two sides of the housing for mounting the electrical connector onto a printed circuit board (PCB). Each board lock comprises a retention portion which interferes with a slot of the housing and a solder portion which is connected with the PCB. Sometimes, the electrical connector can't be reliably mounted on the PCB by a retention force between the housing and the board locks. In the meanwhile, the board locks are respectively assembled to the insulative housing one by one so that assembly efficiency is low.

Hence, an improved electrical connector is highly desired to overcome the aforementioned problems.

SUMMARY OF THE INVENTION

The present invention provides an electrical connector including an insulative housing, a plurality of terminals and a pair of board locks retained in the housing. The insulative housing defines a mating surface, a mounting surface opposite to the mating surface, a plurality of passageways penetrating through the mating surface and a pair of slots penetrating through the mounting face and a first side face of the insulative housing. The terminals are received in the passageways. The board locks are secured in the corresponding slots of the insulative housing. Each board lock includes a retention portion and a lock tail extending from the retention portion beyond the mounting face. The insulative housing further defines a pair of block portions unitarily protruding from the first side face adjacent to the corresponding slots, and each board lock includes a retaining portion abutting against the corresponding block portion on a face opposite to the mounting face.

A method of assembling an electrical connector comprises steps of: providing a plurality of an insulative housing arranged in a row and each loaded with a plurality of conductive terminals, the terminals comprising contacting portion exposing to a mating surface of each insulative housing and connecting portions exposing to a mounting surface of each insulative housing, each insulative housing defines a pair of slots through the mounting face and a first side face adjacent to the mounting face and a pair of block portions unitarily protruding from the first side face; providing two same carriers, each carrier comprising a plurality of board locks, each board lock comprising a retention portion, a lock tail extending towards the mounting face and a retaining portion extending towards the first side face; assembling the board locks in one carrier to the slots of one side of said insulative housings and them assembling the board locks of the other carrier to the slots of the other side of said insulative housing; cutting away the board locks of said two carriers from each other and then bending the retaining portion to abut against the corresponding block portions.

Other objects, advantages and novel features of the invention will become more apparent from the following detailed description when taken in conjunction with the accompanying drawings.

DETAILED DESCRIPTION OF PREFERRED EMBODIMENTS

Reference will now be made in detail to the preferred embodiment of the present invention.

Figure 1:
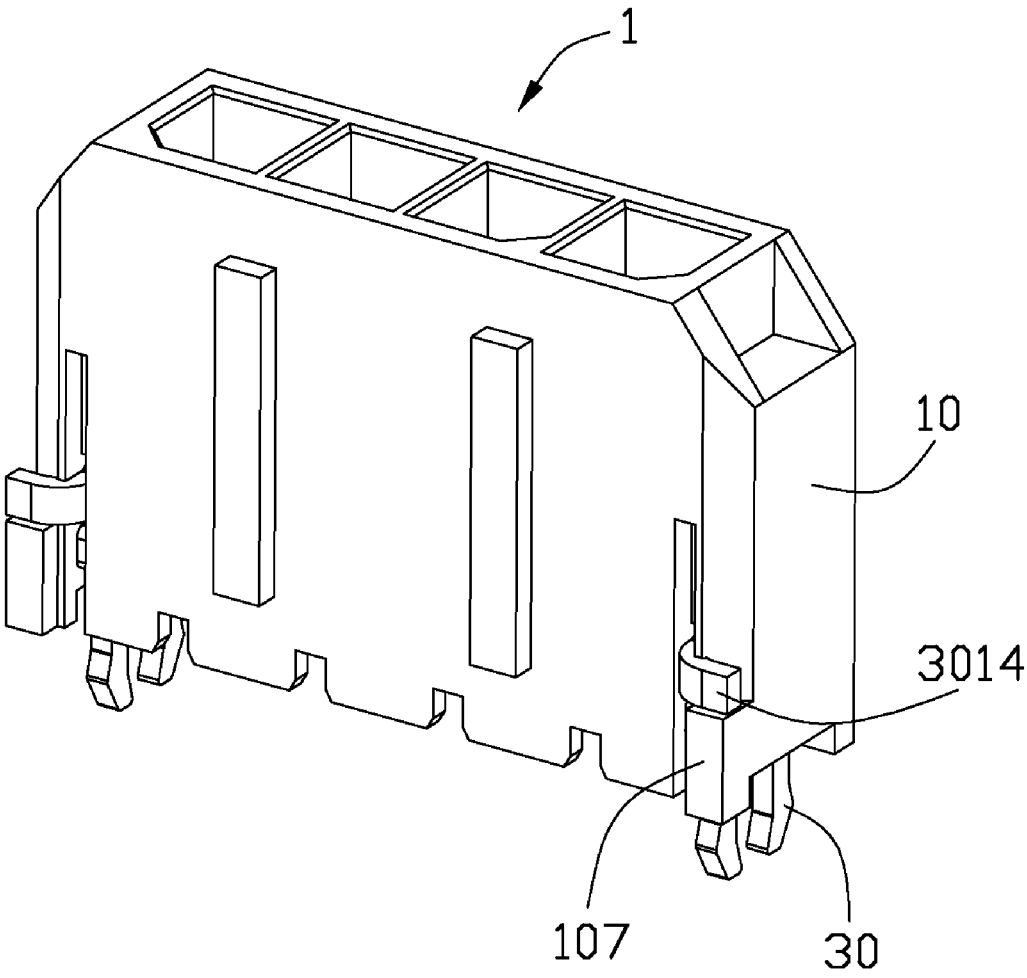
FIG. 1 is a perspective view of an electrical connector of an embodiment of the present invention.

Referring to FIG. 1, an electrical connector 1 in accordance with the present invention adapted for being mounted on a printed circuit board (PCB), comprises a insulative housing 10, a plurality of terminals 20 retained in the insulative housing 1 and a pair of board locks 30 secured at two sides of the insulative housing 1.

Figure 2:
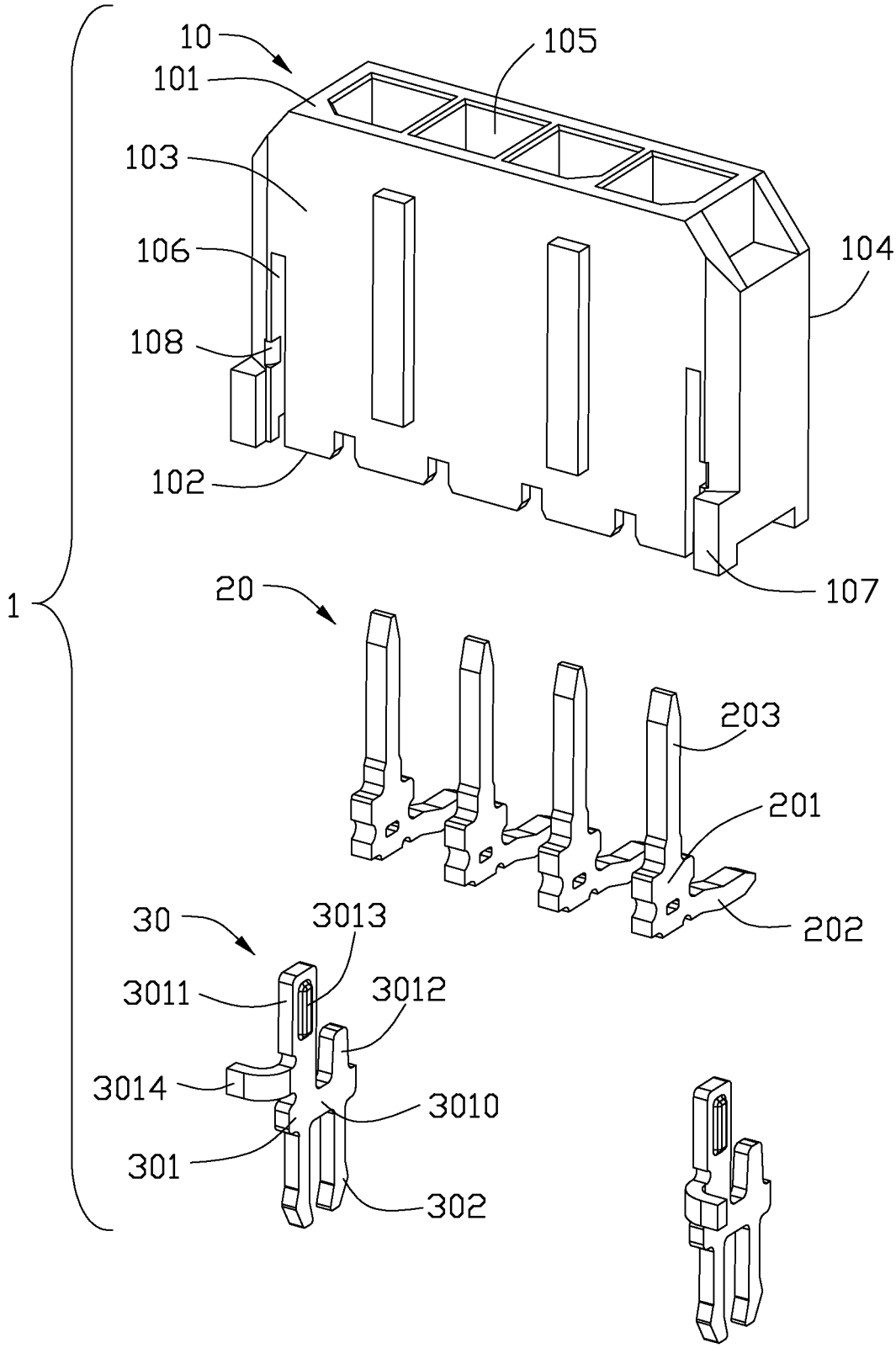
FIG. 2 is an exploded, perspective view of FIG. 1.
Figure 3:
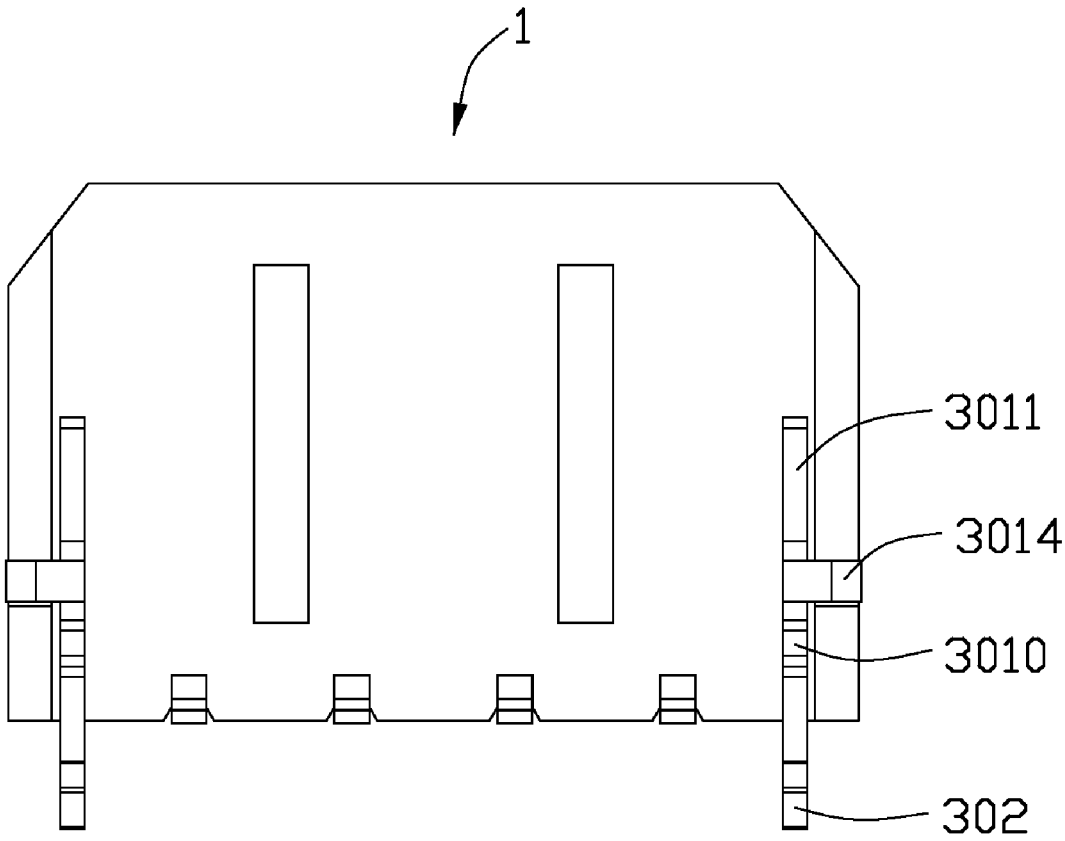
FIG. 3 is a front view of the electrical connector in FIG. 1.

Referring to FIGS. 2 and 3, the insulative housing 10 defines a longitudinal direction along which the terminals 20 are arranged. The insulative housing 10 has a mating face 101, a mounting face 102 opposite to the mating face 101, a first side face 103 and a second side face 104 opposite to the first side face 103. The first side face 103 and the second side face 104 are parallel to each other and perpendicular to the mating face 101 and the mounting faces 102. A plurality of passageways 105 penetrate through the mating face 101 and the mounting face 102 and receive the corresponding terminals 20. The insulative housing 10 has a pair of slots 106 formed at two sides thereof The slots 106 are adapted to secure the corresponding board locks 30, which communicate with the mounting face 102 and the first side face 103. Two block portions 107 unitarily protrude from the first side face 103 and are located adjacent to the corresponding slots 106. A recess 108 is formed in an inner wall of each slot 106 and penetrates through the first side face 103. The recesses 108 are located adjacent to the protrusion 107 so as to facilitate bending of the board lock 30. The block portions 107 are located at an outer side of the slots and near to the mounting face 102.

Each terminal 20 comprises a retention portion 201 retained in the respective passageway 105, a solder portion 202 extending from one end of the retention portion 201 toward the second side face 104 and a mating portion 203 extending from the other end of the retention portion 201 toward the mating face 101. The solder portion 202 is exposed on the mounting face 102 intended to be soldered on the PCB. The mating portion 203 is adapted to mate with a mating terminal of a mating connector (not shown). As a whole each terminal 20 is configured as L-shape.

Each board lock 30 includes a retention portion 301, i.e., the housing retention structure, retained in the slot 106 and a pair of resilient lock tails, i.e., the board retention structure, 302 extending from the retention portion 301 beyond the mounting face 102. The retention portion 301 comprises a board portion 3010, first and second retention arms 3011, 3012 extending from a same side of the board portion 3010 toward the mating face 101. The first retention arm 3011 is longer than the second retention arm 3012. A pair of protrusions 3013 projects from two opposite sides of the first retention arms 3011 to interfere with inner walls of the slot 106. The board lock 30 further comprises a retaining portion 3014 bending from the first retention arm 3011 and abutting against an upper surface of the block portion 107 to prevent the board lock 107 from departing from mounting face of the insulative housing 10 to ensure a stable retaining force between the connector 1 and the PCB. The retaining portions 3014 of two board locks 30 extend in a same plane perpendicular to the other portion of the board locks and in opposite directions so as to provide a balanced retention force between the electrical connector 1 and the PCB.

In assembly, firstly the terminals 20 are respectively inserted into the corresponding passageways 105 of the insulative housing 10 from the mounting face 102. Secondly, two carriers with a plurality of interconnected board locks are provided. The plurality of board locks 30 are spaced from each other with a specified distance, wherein the retaining portions 3014 extend in a same plane of the board locks without any bending and the board locks are connecting with each other by a carrier portion (not shown) connecting with the retaining portions. The board locks 30 in one carrier are assembled to a plurality of arranged insulative housings 10 in a line from the mounting faces 102 so that the retention portions 301 of the board locks 30 interfere with the slots 106 of one side of the insulative housings 10. The board locks 30 in another carrier are assembled to said insulative housings 10 so that the retention portions 301 of the board locks 30 interfere with the slots 106 of the other side of the insulative housing 10. Then, the carrier portions of the two carrier are respectively cut away, and the retaining portions 3014 then bent and are abut against the corresponding block portions 107. The method of assembly facilitates the assembly process of the electrical connector 1.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector, comprising:

an insulative housing defining a mating surface, a mounting surface opposite to the mating surface, a plurality of passageways penetrating through the mating surface and a pair of slots penetrating through the mounting face and a first side face of the insulative housing;

a plurality of terminals received in the passageways; and a pair of board locks secured in the corresponding slots of the insulative housing, each board lock comprising a retention portion and a lock tail extending from the retention portion beyond the mounting face;

wherein the insulative housing further defines a pair of block portions unitarily protruding from the first side face adjacent to the corresponding slots, each board lock comprises a retaining portion abutting against the corresponding block portion on a face opposite to the mounting face.

2. The electrical connector as recited in claim 1, wherein each slot defines a recess running through the first side face and located adjacent to the block portion to facilitate bending the retaining portion.

3. The electrical connector as recited in claim 2, wherein the terminals comprise contacting portions toward the mating face and connecting portions exposing to the mounting face, the connecting portion extending toward a second side face opposite to the first side face.

4. The electrical connector as recited in claim 1, wherein the retaining portions of the pair of the board locks extend in opposite directions.

5. The electrical connector as recited in claim 4, wherein each board lock comprises a pair of parallel first and second retention arms extending to the mating face, the first retention portion has protrusions at two opposite sides thereof, said retaining portions bend from the first retention arm.

6. The electrical connector as recited in claim 5, wherein the first retention portions are longer than second retention portions.

7. The electrical connector as recited in claim 1, wherein the retaining portions are disposed perpendicularly to other portion of the board locks, said other portions are perpendicular to the first side face.

8. An electrical connector comprising:

an insulative housing defining a plurality of passageways and a pair of slots at two opposite lengthwise ends in a lengthwise direction;

a plurality of contacts disposed in the corresponding passageways, respectively;

a pair of board locks disposed in the corresponding slots, respectively;

the housing defining a mounting face and a side face adjacent to each other, the slot communicating with an exterior via in both said mounting face and the side face;

said board lock essentially defining an upper housing retention structure and a lower board retention structure commonly lying in a vertical plane, and a bent retention portion extending from the upper housing retention structure and away from said vertical plane and further through the side face and eventually engaged with a block portion on the housing; wherein the board lock is assembled into the slot from the mounting face in a first direction, and engagement between the bent retention portion and the block portion prevents the board lock from moving in a second direction opposite to said first direction.

9. The electrical connector as claimed in claim 8, wherein the block portion is formed on the side face.

10. The electrical connector as claimed in claim 8, wherein said bent retention portion is bent to a final position for engagement with the block portion only after the whole board lock is fully inserted into the corresponding slot.

11. The electrical connector as claimed in claim 8, wherein said block portion is essentially located at the lengthwise end.

* * * * *